United States Patent [19]

Smith

[11] Patent Number: 4,491,320

[45] Date of Patent: Jan. 1, 1985

[54] HOCKEY PRACTICE DEVICE

[75] Inventor: David G. Smith, Saskatoon, Canada

[73] Assignee: Wetzikon Holdings Ltd., Calgary, Canada

[21] Appl. No.: 558,464

[22] Filed: Dec. 6, 1983

[51] Int. Cl.[3] ..... A63B 69/00; A63B 59/12

[52] U.S. Cl. ..... 273/1 B; 273/194 B; 273/200 B; 273/67 A

[58] Field of Search ..... 273/1 B, 128 R, 67 A, 273/194 B, 194 A, 200 B

[56] References Cited

U.S. PATENT DOCUMENTS

| | | |
|---|---|---|
| 3,529,825 | 9/1970 | White, Sr. . |
| 3,834,697 | 9/1974 | McNamara, Jr. et al. . |
| 3,863,917 | 2/1975 | Beale . |
| 4,023,797 | 5/1977 | Sarrasin . |
| 4,111,419 | 9/1978 | Pellegrino . |
| 4,343,468 | 8/1982 | Lindgren . |

FOREIGN PATENT DOCUMENTS

| | | |
|---|---|---|
| 125803 | 5/1910 | Canada . |
| 850516 | 9/1970 | Canada . |
| 967606 | 5/1975 | Canada . |

*Primary Examiner*—Paul E. Shapiro

*Attorney, Agent, or Firm*—Mitchell B. Wasson; Martin P. Hoffman

[57] ABSTRACT

Ice hockey practice equipment for improving puck handling skills including a puck-like member having a groove in an upper surface thereof for receiving a hockey stick blade, and a locating member for maintaining the blade in location within the groove with lost motion between the puck-like member and the blade, the equipment thereby permitting constant interaction and feel of the puck-like member and the blade for a trainee.

23 Claims, 6 Drawing Figures

HOCKEY PRACTICE DEVICE

FIELD OF THE INVENTION

The present invention relates to hockey practice equipment for improving technical skills. Specifically, the present invention relates to a puck-like member which is attachable to a hockey stick blade and used as a training device for improving an individual's shooting, passing and puck handling skills.

BACKGROUND OF THE INVENTION

For the effective play of hockey, an individual must possess good shooting, passing and puck handling skills. For the novice or intermediate player, these technical skills can only be acquired through repetitions of predetermined procedures aimed at improving these skills. However, during practice sessions, much time can be wasted chasing loose pucks, creating an unnecessary loss of skill-learning time and wasted energy and effort on the part of the instructor/coach and the learning player. In addition, shooting and puck handling practice sessions usually take place on the hockey rink, thereby occupying the hockey rink when the facilities could be used for other important activities.

SUMMARY OF THE INVENTION

Objects of the present invention are to provide a hockey practice device by which no time is lost chasing loose pucks, learning of the necessary basic skills of hockey is facilitated, and use on any indoor or outdoor flat surface is possible.

These objects may be achieved by attaching a puck substitute to a hockey stick blade whereby the substitute can move freely along the blade, but never actually leave the blade.

Thus, in accordance with a broad aspect of the present invention; there is provided a hockey practice device which comprises puck means having a groove in an upper surface thereof for receiving a hockey stick blade and locating means for maintaining said blade in location within said groove with lost motion between the puck means and the blade.

The puck means may be a disk member adapted to receive the blade and the locating means may be a pin which passes through a slot in the blade.

Thus, a preferred device of the present invention includes a hockey stick blade, which has a slot along its base, and a puck-like disk, which has a groove on its upper surface for receiving the blade. The disk is attached to the blade by a pin, with the diameter of the pin being smaller than the width of the slot so that the disk can move freely along the slot in the blade. The blade may be an integral part of a hockey stick or may be adapted to receive a shaft, such as the shaft of a bladeless hockey stick.

Therefore, in accordance with a preferred aspect of the present invention, there is provided a hockey practice device which comprises:

(a) a hockey stick blade having an open slot along the length of said blade;

(b) a disk member having a groove on an upper surface thereof for receiving said blade; and (c) pin means located in said disk member and traversing said groove, said pin means having a smaller diameter than the width of said slot and passing through said slot thereby connecting the disk member to the blade with lost motion therebetween.

BRIEF DESCRIPTION OF THE DRAWINGS

The present invention is described in more detail below, by way of example only, with reference to the accompanying drawings in which.

DESCRIPTION OF THE PREFERRED EMBODIMENTS

Figures 1, 6:
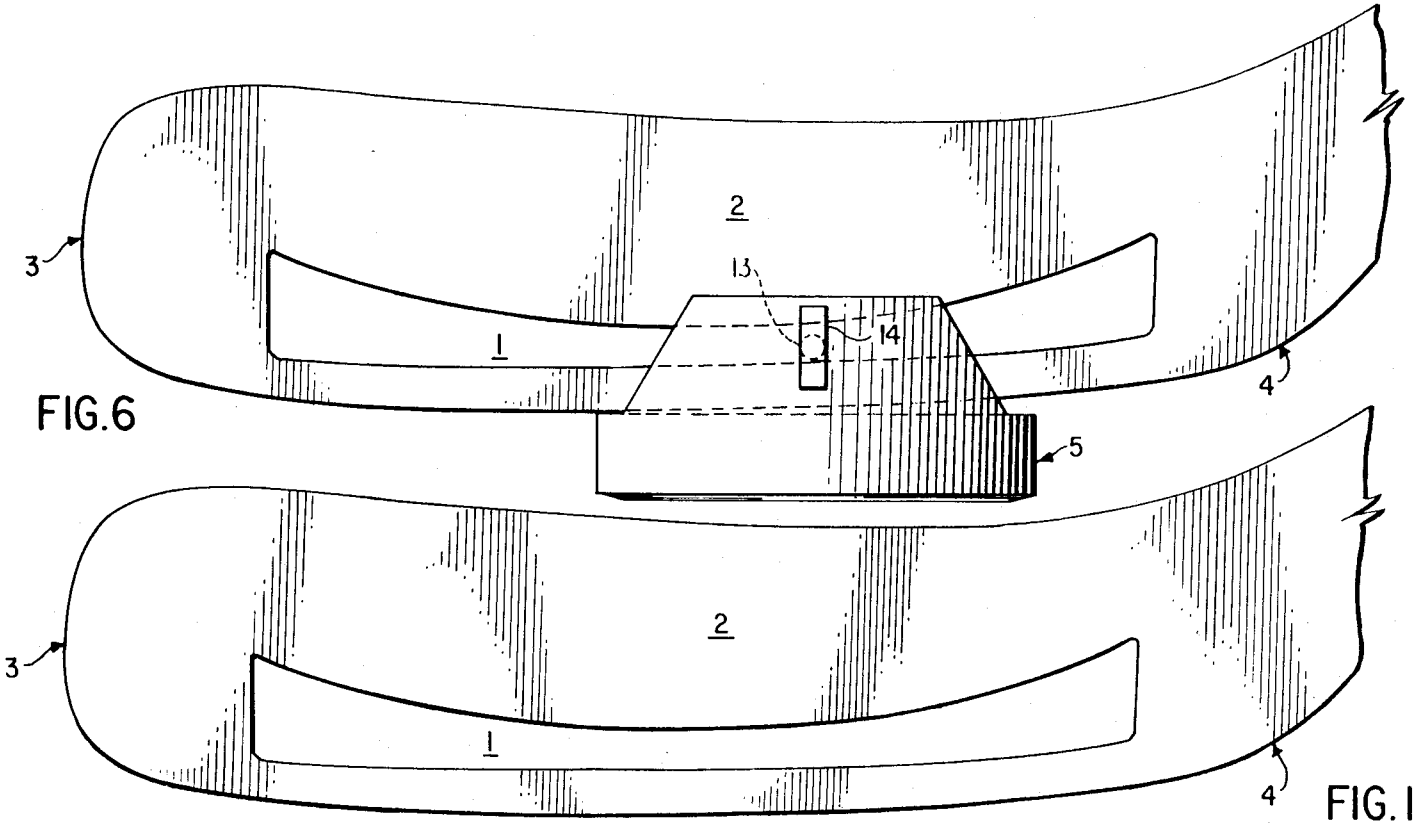
FIG. 1 is a side view of a preferred embodiment of a blade of the present invention.
FIG. 6 is a side view illustrating the blade of FIG. 1 located with the disk of FIG. 2 by the pin means.

FIG. 1 illustrates a preferred practice device of the present invention. The blade is generally conventional in dimension with a slot 1 running approximately parallel to the base of the blade 2. Preferably, the slot 1 is of varying width, about 1 cm in the middle and about 2.5 cm at its ends, with the lower edge of the slot 1 being about 1 cm from the base of the blade 2. It is also preferred that the ends of the slot 1 are not more than about 4 cm from the toe 3 and the heel 4 of the blade. A plastic insert may be placed along the edges of the slot to reduce wear.

At its heel 4, the blade 2 may have a shaft, like a conventional hockey stick, or may be adapted to receive a shaft, such as the shaft of a bladeless hockey stick.

Figure 2:
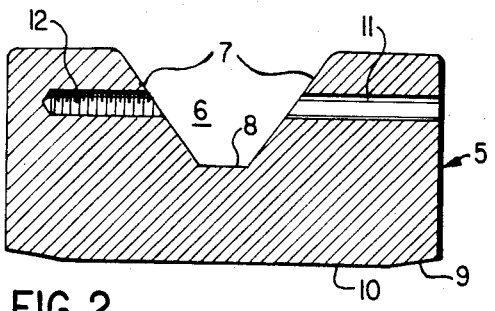
FIG. 2 is a cross section of a preferred embodiment of a disk of the present invention.
Figure 4:
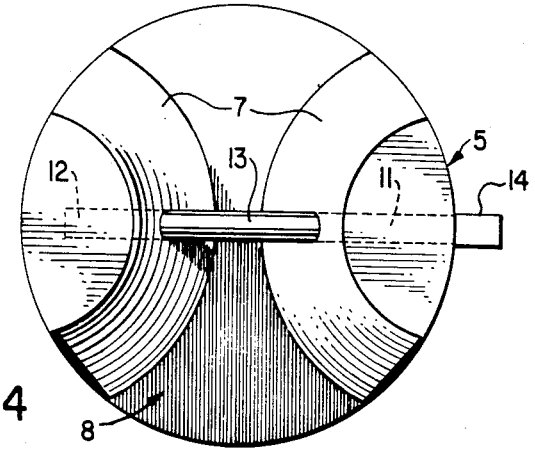
FIG. 4 is a plan view of a preferred embodiment of the disk and pin means of the present invention.

FIG. 2 illustrates a puck-like disk 5 of the present invention. The disk 5 has a groove 6 on its upper surface for receiving the blade 2. The disk 5 is about 5.5 cm in height and about 10 cm in diameter, the depth of the groove 6 being about 2.54 cm. Thus, the height of the walls 7 of the groove 6 contacting the blade 2 are about the same height as a conventional hockey puck. The width of the groove 6 at its base 8 is about 1 cm at its length center. The walls 7 of the groove 6 rise at an angle, in the range of about 120° to 140° preferably 125°, from the base 8 of the groove 6, as illustrated in FIG. 2. As illustrated in FIG. 4, the walls 7 of the groove 6 are convex along their length such that the base 8 of the groove 6 is narrower at its center than at its ends. Thus, the walls 7 defining the base 8 of the groove 6 are arcuate, preferably with a radius equal to the radius of a conventional hockey puck. Because the walls 7 are angled, the top of groove 6 has a smaller radius than the base 8.

In addition, it is preferred that edges of the disk 5 are bevelled. The edge 9 of the bottom surface 10 of the disk 5 may be bevelled at about 15°, so that the bottom surface 10 is about 7.62 cm in diameter, this being the diameter of a conventional hockey puck.

The disk 5 may be made of metal, with a preferred weight range of about ½ to 2 kilograms.

Figure 3:
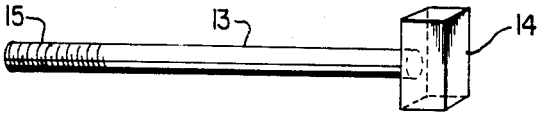
FIG. 3 is a perspective view of a preferred embodiment of pin means of the present invention.
Figure 5:
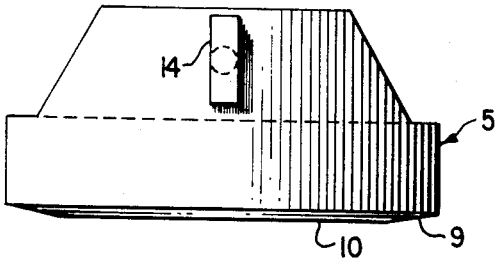
FIG. 5 is a side view of a preferred embodiment of the disk and pin means of the present invention.

In the preferred embodiment of FIG. 3, the pin means is a 10 cm dowel 13, about 9 cm of which has a diameter of approximately 0.6 cm. The remaining 1 cm, at one end 14, being 0.6 cm in width and 2 cm in height. Near the upper surface of the disk 5 there is a 9 cm long bore 11, 12, the center of the bore 11,12 being about 1.3 cm from the upper surface of the disk 5; as illustrated in FIG. 2. The diameter of the bore 11,12 is slightly wider than about 0.6 cm, so that the 0.6 cm diameter portion of the dowel 13 fits snugly within the bore 11,12. The bore 11,12 and the dowel 13 positioned therein (FIGS. 4 and 5) runs transverse to the groove 6, thereby dividing the bore 11,12 into an open bore 11 and a blind bore 12.

Approximately 2.2 cm of the leading end 15 of the dowel 13 is threaded with a reciprocating thread in the blind bore 12.

This embodiment of the present invention is assembled by placing the blade 2 in the groove 6 of the disk 5, then passing the dowel 13 through the open bore 11, and thence across the slot 1 in the blade 2. Thereafter the dowel 13 is threaded into the blind bore 12, to provide the hockey practise device of the present invention as generally illustrated in FIG. 6.

The width of a conventionally dimensioned hockey stick blade is tapered from approximately 0.75 cm at the heel to approximately 0.5 cm at the toe. As assembled, the lost motion between the disk and the blade allow the proper hockey stick rotation which is required in shooting and puck handling. The slot in the blade allows the disk to move along the length of blade, while the dowel guides the disk to the desired shooting or puck handling position on the blade. Thus the disk will not leave the blade so that no time is wasted chasing loose pucks.

The 125° angle of the sides of the groove allows the sides of the blade angular movement, about a horizontal axis, through 70° which is technically necessary for the proper shooting of a hockey puck. The sides of the groove forming circumscribed arcs simulate the outer edge of a conventional hockey puck thereby providing the same effect a conventional hockey puck has on a conventional hockey stick. In addition, the circumscribed arcs permit angular movement about a vertical axis of the length of the blade relative to the disk. Thus, the present invention aids in the teaching of shooting, passing and puck handling skills, without the disk leaving the blade.

In addition, the bevelled edges of the disk allow easier use of this practice device on any indoor or outdoor flat surface. Thus, proper hockey techniques can be practised without occupying the hockey rink facilities, so that the rink may be used for other activities.

What I claim as my invention is:

1. A hockey practice device which comprises puck means having a groove in an upper surface thereof for receiving a hockey stick blade and locating means for maintaining said blade in location within said groove with lost motion between the puck means and the blade.

2. A hockey practice device according to claim 1 wherein said locating means permits movement of the puck means along the blade.

3. A hockey practice device according to claim 1 wherein said locating means permits angular movement about a horizontal axis of the sides of the blade relative to the puck means.

4. A hockey practice device according to claim 1 wherein said locating means permits angular movement about a vertical axis of the length of the blade relative to the puck means.

5. A hockey practice device which comprises:

(a) a hockey stick blade having an open slot along the length of said blade;

(b) a disk member having a groove on an upper surface thereof for receiving said blade; and (c) pin means located in said disk member and traversing said groove, said pin means having a smaller diameter than the width of said slot and passing through said slot thereby connecting the disk member to the blade with lost motion therebetween.

6. A hockey practice device according to claim 5 wherein said blade is adapted to receive a shaft.

7. A hockey practice device according to claim 5 wherein said blade is integral with a hockey stick shaft.

8. A hockey practice device according to claim 7, wherein at least a portion of the base of the groove is about 1 cm in width.

9. A hockey practice device according to claim 5, wherein said groove has walls disposed at an angle from about 120° to about 140° from a base of said groove, thereby permitting angular movement about a horizontal axis of the sides of the blade relative to the disk member.

10. A hockey practice device according to claim 9, wherein said angle is about 125°.

11. A hockey practice device according to claim 9, wherein the walls of the groove are convex along their length such that the base of the groove at the center of its length is narrower than the base of the groove at ends of the groove thereby permitting angular movement about a vertical axis of the length of the blade relative to the disk member.

12. A hockey practice device according to claim 11, wherein said walls adjacent the base of the groove are arcuate with a radius substantially equal to a radius of a conventional hockey puck.

13. A hockey practice device according to claim 11, wherein said walls adjacent a top of the groove are arcuate with a radius smaller than a radius of a conventional hockey puck.

14. A hockey practice device according to claim 5, wherein said disk member is about 5.5 cm in height and about 10 cm in diameter.

15. A hockey practice device according to claim 14, wherein said groove is about 2.54 cm in depth and about 1 cm in width at a base of said groove.

16. A hockey practice device according to claim 5, wherein said disk member has a bottom peripheral edge which is bevelled at about 15° from a bottom surface of the disk member.

17. A hockey practice device according to claim 5, wherein said disk member being made from metal.

18. A hockey practice device according to claim 5, further comprising said disk member having a bore adjacent said upper surface thereof traversing said groove, for receiving said pin means.

19. A hockey practice device according to claim 5, said slot being wider at a toe end and a heel end than at a center thereof.

20. A hockey practice device according to claim 19, said slot being about 1 cm in width at said center and about 2.5 cm in width at said toe and heel ends.

21. A hockey practice device according to claim 19, said toe end being about 4 cm from a toe of said blade and said heel end being about 4 cm from a heel of said blade.

22. A hockey practice device according to claim 19 wherein a lower edge of the slot is about 1 cm from the base of the blade.

23. A hockey practice device according to claim 5 wherein said disk member being in a weight range of about ½ to 2 kilograms.

* * * * *